United States Patent [19]

Erickson et al.

[11] 4,270,816

[45] Jun. 2, 1981

[54] FURNITURE HAVING PRESTRESSED FABRIC PANELS

[75] Inventors: David L. Erickson; Leonard W. Kitts, both of Milwaukee, Wis.

[73] Assignee: Interface Design Group, Inc., Milwaukee, Wis.

[21] Appl. No.: 5,785

[22] Filed: Jan. 23, 1979

[51] Int. Cl.[3] ..... E04H 10/02; E04H 1/12

[52] U.S. Cl. ..... 312/3; 312/6; 312/297; 135/5 B

[58] Field of Search ..... 312/3, 1, 6, 5, 111, 312/107, 257 SK, 257 A, 257 SM, 297, 259, 193, 183; 108/111; 135/5 B; 5/114

[56] References Cited

U.S. PATENT DOCUMENTS

| | | | |
|---|---|---|---|
| 436,482 | 9/1890 | Killinger | 135/5 B |
| 957,423 | 5/1910 | Klepfer | 312/183 |
| 2,305,279 | 12/1942 | Smith | 312/3 |
| 2,440,192 | 4/1948 | Cowan | 312/6 |
| 2,517,757 | 8/1950 | Adlerstein | 312/3 |
| 2,639,819 | 5/1953 | Marks | 312/6 |
| 2,672,627 | 3/1954 | Hagelfeldt | 5/114 |
| 2,683,507 | 7/1954 | Coven et al. | 312/297 |
| 2,715,559 | 8/1955 | Villo | 312/107 |
| 3,172,376 | 3/1965 | Havlis | 108/111 |
| 3,570,418 | 3/1971 | Gooding | 108/111 |
| 3,712,697 | 1/1973 | Kelley et al. | 312/297 |
| 3,904,258 | 9/1975 | Faulkenberry | 312/6 |

FOREIGN PATENT DOCUMENTS

| | | | |
|---|---|---|---|
| 1434891 | 2/1966 | France | 312/297 |
| 1445789 | 6/1966 | France | 312/3 |

*Primary Examiner*—Victor N. Sakran

*Attorney, Agent, or Firm*—Andrus, Sceales, Starke & Sawall

[57] ABSTRACT

Pieces of furniture have a pair of spaced side plates with rods extending between them. One or more sheets of tensilely stressed fabric are secured to and around the rods. The resulting panels may comprise structural elements of the furniture, such as the top, back, bottom, shelves, bins, and the like.

23 Claims, 8 Drawing Figures

Fig. 4
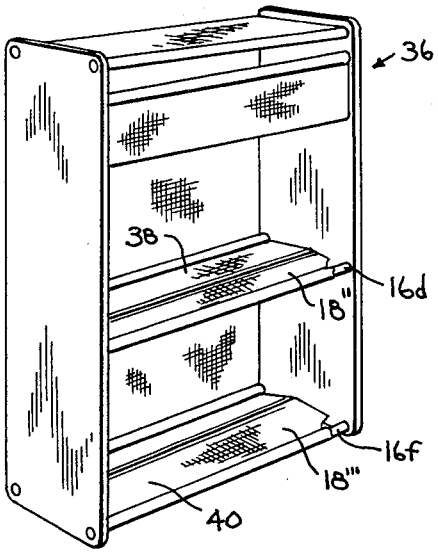
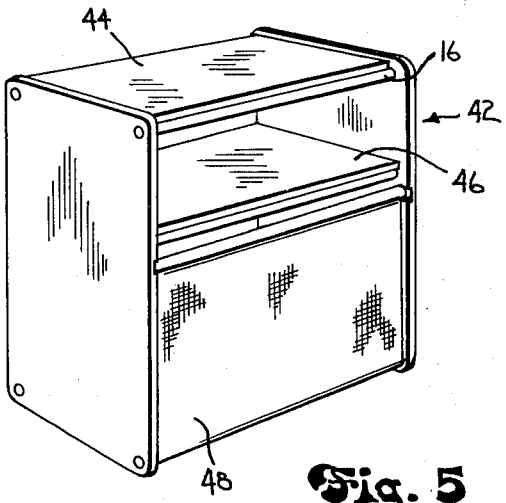
Fig. 5
Fig. 6
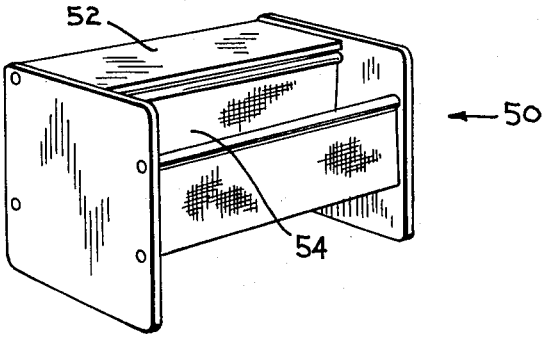
Fig. 7
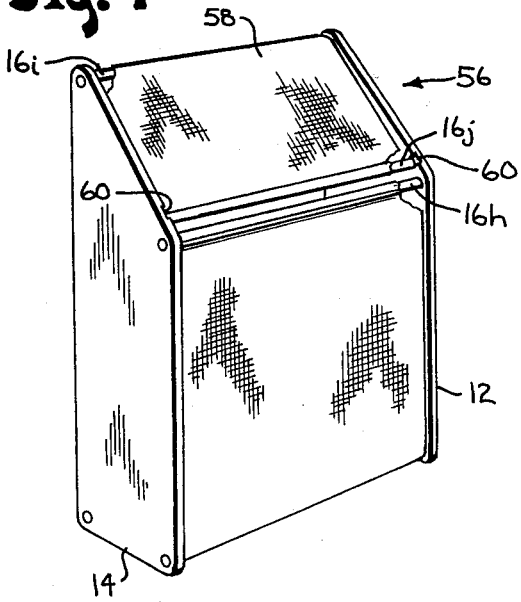
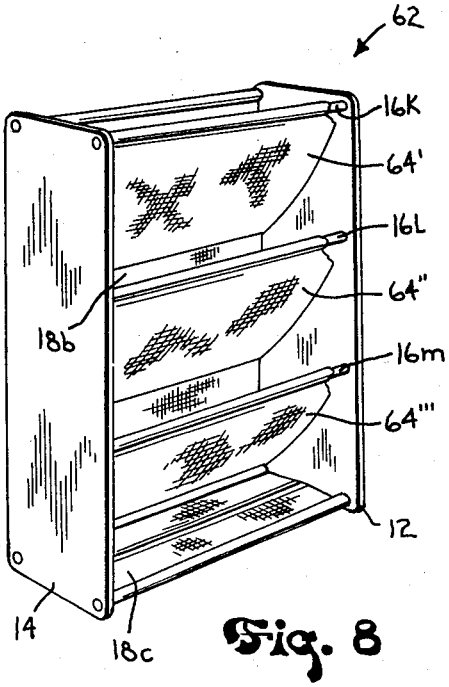
Fig. 8

FURNITURE HAVING PRESTRESSED FABRIC PANELS

BACKGROUND AND SUMMARY OF THE PRESENT INVENTION

The present invention relates to furniture incorporating panel-like structural elements formed from stressed fabric. The furniture so formed is flexible in design and execution, enabling a wide variety of different types and styles of furniture to be constructed in accordance with the basic concept of the invention. The furniture is light in weight yet sturdy in construction. The fabric portions may be removed for washing or dying or for replacement because of wear, to change the color, or for other reasons.

Briefly, furniture of the present invention includes a pair of spaced side plates. The plates are typically vertically oriented and horizontally spaced to define the height and depth of the furniture. A plurality of rods extend between the plates to define the width of the furniture. The rods are located on the plates so that pairs of rods demarcate the location of generally planar panel elements. A sheet of fabric tensilely stressed in a direction parallel to the side plates is secured to one of the rods, deflected about others of the rods, and secured to another rod to form panels of the furniture. An end portion of the sheet beyond the securing rod may form a movable portion of the furniture, such as a shelf front or lid.

Additional sheets of fabric may be attached to the tensilely stressed sheet. These additional sheets may also be tensilely stressed to form further elements of the furniture, such as shelves, or may be unstressed to form elements such as storage bins.

BRIEF DESCRIPTION OF THE DRAWING

FIGS. 4 through 8 illustrate other embodiments of furniture utilizing the principles of the present invention; FIG. 4 showing a book case; FIG. 5 showing a television/phonograph stand; FIG. 6 showing an end table; FIG. 7 showing a laundry hamper; and FIG. 8 showing a multi-bin storage hamper.

DETAILED DESCRIPTION OF THE PREFERRED EMBODIMENT

Figure 1:
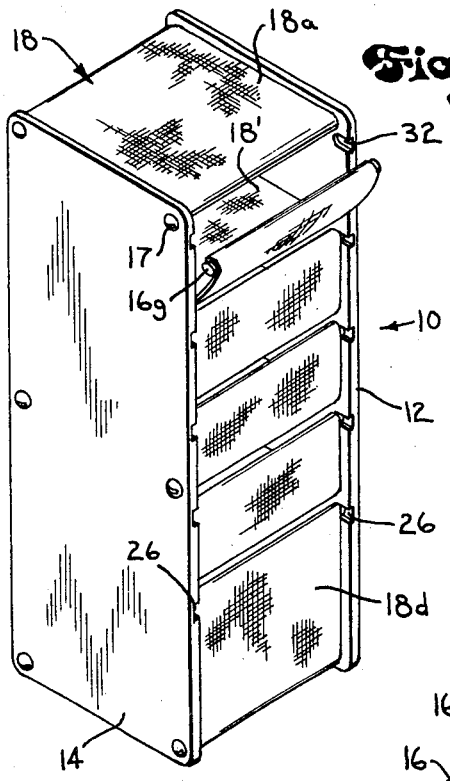
FIG. 1 is a perspective view of one embodiment of the furniture of the present invention, a chest being shown for exemplary purposes.
Figure 2:
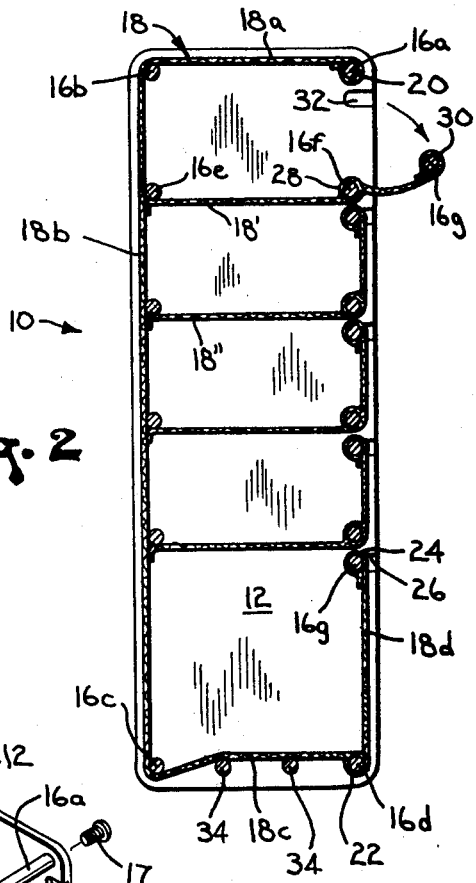
FIG. 2 is a cross-sectional view of the chest shown in FIG. 1.
Figure 3:
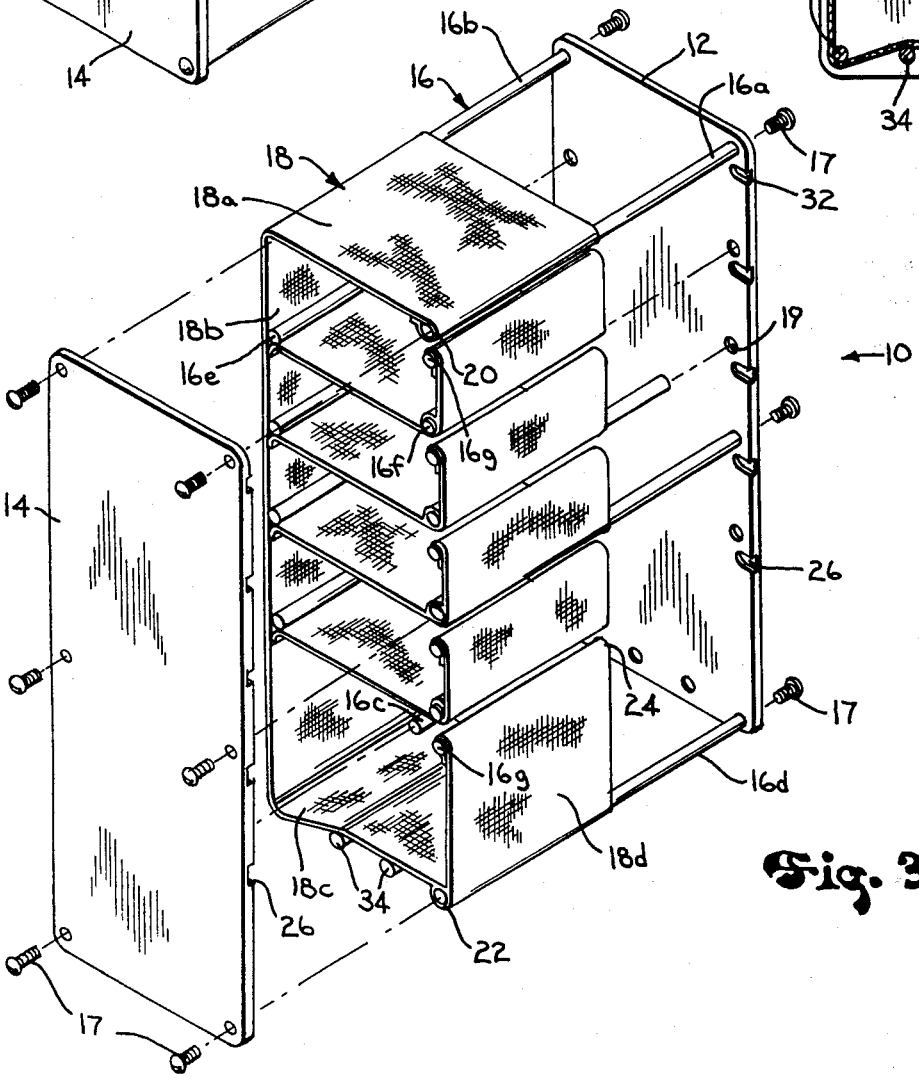
FIG. 3 is an exploded view of the chest of FIG. 1 showing the details of its construction.

FIGS. 1, 2, and 3 show one embodiment of the furniture of the present invention in the form of a chest 10. Chest 10 includes plates 12 and 14. Plates 12 and 14 are typically vertically oriented and horizontally spaced. The dimensions of plates 12 and 14 define the height and depth of chest 10. The thickness of plates 12 and 14 is sufficient to provide structural strength and rigidity to chest 10 and plates 12 and 14 may be formed of plywood, plastic laminate, or other material presenting desired structural strength and asthetic surface properties.

Rods 16 extend horizontally between plates 12 and 14. As shown most clearly in FIGS. 2 and 3, rods 16 are so positioned between panels 12 and 14 as to demarcate the location of generally planar panel-like elements of the chest. For example, rods 16*a* and 16*b* are positioned between panels 12 and 14 in the same horizontal plane to demarcate the position of a top panel element of chest 10. Rods 16*b* and 16*c* are positioned between panels 12 and 14 in the same vertical plane to demarcate the position of a back panel element of chest 10. Rods 16*c* and 16*d* are positioned between panels 12 and 14 in the same horizontal plane to demarcate the position of a bottom panel element of chest 10. As shown most clearly in FIG. 3, certain of rods 16 may be attached to plates 12 and 14 and fastened as by screw fasteners 17 to form the plates and rods into a unitary structure. Others of rods 16 may be retained in plates 12 and 14 by inserting their ends in recesses 19 on the plates.

Rods 16*e* and 16*f* intermediate rods 16*b* and 16*c* and 16*a* and 16*d*, define a shelf parallel to the top and bottom of chest 10. Rod 16*g*, with rod 16*f*, forms a front to the shelf. Additional rods 16 may be used to form other shelves, as shown in FIG. 2.

An elongated sheet of fabric 18, equal in width to the spacing between plates 12 and 14, has one end secured to rod 16*a*, as by loop 20, is stretched over and around rods 16*b*, 16*c*, and is secured to rod 16*d* as by loop 22 sewn in sheet 18 at a point spaced from the end of the sheet. The stretching of sheet 18 stresses it tensilely in a direction parallel to the planes of plates 12 and 14. The amount of such tensile stress is, of course, variable but is preferably such that the deflection of the fabric is minimal when ordinarily anticipated static or dynamic loads are applied to the panels. Anticipated dynamic loads include the impacts the piece of furniture can reasonably expect to receive in use and the anticipated static loads include the weight of objects placed on the panel elements. The weight of the fabric may also be selected with a view toward minimizing deflection. For example, a material such as 10 oz. canvas duck has been found useful in the furniture of the present invention.

Sheet 18 forms top panel 18*a*, back panel 18*b*, and bottom panel 18*c* of chest 10. The end portion 18*d* of sheet 18 beyond loop 22 and rod 16*d* terminates in loop 24 about rod 16*g*. Rod 16*g* is removably mounted on plates 12 and 14, as by inserting its ends in slots 26 which open to the edges of plates 12 and 14. Panel 18*d* is stressed only by the amount needed to retain rod 16*g* in slots 26, as by frictional engagement. This tension is typically considerably less than that found in panels 18*a*, 18*b*, and 18*c*. Removal of rod 16*g* from slots 26 permits end portion 18*d* to collapse so that articles may be deposited on, and removed from, the upper surface of bottom panel 18*c*.

Also as shown in FIG. 2, a plurality of additional sheets, such as sheets 18′, 18″, etc. may be sewn at intervals along strip 18, as along back panel 18*b*. The point of attachment of sheet 18″ is proximate to rod 16*e* and loop 28 sewn in the medial portion of sheet 18′ is secured around rod 16*f* so that panel 18′ is tensilely stressed parallel to plates 12 and 14 forming an additional shelf in chest 10. The free end of sheet 18′ beyond loop 28 and rod 16*f* terminates in loop 30 about rod 16*g* which is removably mounted in slots 32 in plates 12 and 14 to form a front for the shelf. The remainder of the shelves in chest 10 are formed in a similar manner. Loop 28 and rod 16*f* help to prevent objects placed on the shelf from rolling out.

While the tautness of sheets 18, 18′, 18″, etc. is oridinarily sufficient to support most normal loads, additional rods may be provided beneath the shelves for support or to lend structural rigidity to chest 10, such as rods 34 shown beneath bottom shelf 18*c*.

FIG. 4 shows a bookcase 36 constructed in accordance with the present invention. The top, back, and bottom panels may be formed in the same manner as the corresponding elements of chest 10. The lower shelves 38 and 40 may be formed by terminating sheets, such as sheets 18″ and 18‴ at rods 16*d* and 16*f*. An enclosed top section similar to the shelves of chest 10 may also be provided in bookcase 36.

For exceptionally heavy loads such as a television set or a phonograph, it may be desirable to use a horizontal plate for supporting such loads in the furniture. FIG. 5 shows a television or phonograph stand 42 having a plate 44 supported by rods 16. An intermediate shelf formed by a second plate 46 may also be provided. A sheet of stressed fabric may form the back and bottom panels of stand 42 with movable front panel 48 permitting access to the lower compartment for storing phonograph records.

FIG. 6 shows an end table 50 having a plate 52 and a stressed fabric panel trough 54 for magazines and the like.

FIG. 7 shows a hamper 56 having three stressed fabric panels forming the back, bottom, and front receptacle portions. The panels may be formed by a stressed strip which is anchored in rod 16*h* at one end and at rod 16*i* at the other end. The lid 58 for the hamper is formed from the end portion of the strip which is looped around rod 16*j* mounted in grooves 60 in plates 12 and 14 in the same manner as the shelf fronts of chest 10.

While the pieces of furniture described above have generally had stressed fabric panels for the non-movable elements, it is also possible to combine stressed and unstressed fabric panels in a piece of furniture. FIG. 8 shows storage hamper 62 of a different construction having stressed fabric panels 18*b* and 18*c* forming the back and bottom panels of the unit. Three triangular shaped bins are provided by unstressed sheets 64′, 64″, and 64‴. The outer ends of sheets 64′, 64″, and 64‴ are held by rods 16*k*, 16L, and 16*m* around which the ends of the sheets are looped so that the sheets are rather loosely suspended between their point of attachment on panel 18*b* and the rods. The edges of the sheets typically will not be fastened to the interior surfaces of plates 12 and 14.

I claim:

1. A piece of furniture comprising:

a pair of spaced, rigid side plates having dimensions which define first and second dimensions of the piece of furniture;

a plurality of rods extending between said spaced side plates, said rods comprising the sole means for establishing and maintaining the third dimension of the piece of furniture, said rods being so located on said plates that pairs of rods demarcate the location of generally planar panel elements of the piece of furniture; and a sheet of fabric stressed only in tension in a direction parallel to said side plates, said sheet being affixed solely to at least a pair of said rods for forming a generally planar panel element of the piece of furniture.

2. The piece of furniture according to claim 1 wherein said fabric sheet is deflected about another of said rods intermediate said pair of rods for forming a plurality of panel elements of the piece of furniture.

3. The piece of furniture according to claim 2 wherein said fabric sheet is deflected about a plurality of rods intermediate said pair of rods.

4. The piece of furniture according to claim 1 including an additional sheet of fabric attached to said first tensilely stressed sheet and secured to a rod to define an additional panel element of said piece of furniture.

5. The piece of furniture according to claim 4 wherein said additional sheet of fabric is tensilely stressed.

6. The piece of furniture according to claims 4 or 5 including a rod adjacent the point of attachment of said additional sheet to said first tensilely stressed sheet for coacting with said first tensilely stressed sheet and said additional sheet.

7. The piece of furniture according to claims 4, 5, or 6 wherein said additional sheet is deflected by a rod.

8. The piece of furniture according to claim 4 including a plurality of additional sheets of fabric attached to said first tensilely stressed sheet and secured to rods to define additional panel elements of said piece of furniture.

9. The piece of furniture according to claim 8 wherein at least one of said additional sheets of fabric is tensilely stressed.

10. The piece of furniture according to claim 8 including rods adjacent said points of attachment of said additional sheets for coacting with said first tensilely stressed sheet and said additional sheets.

11. The piece of furniture according to claim 8 wherein at least one of said additional sheets is deflected by a rod.

12. The piece of furniture according to claim 8 wherein said additional sheets are fastened at spaced intervals along said first tensilely stressed sheet.

13. The piece of furniture according to claim 5 wherein said additional sheet is secured to a rod intermediate its end for forming said stressed panel element and wherein the end portion of said sheet beyond said intermediate rod is secured to a rod removably mounted between said plates to form a movable element of said piece of furniture.

14. The piece of furniture according to claim 13 wherein said piece of furniture comprises a chest, said first sheet of tensilely stressed fabric comprising the top, back, and bottom panel elements of said chest, said stressed panel element of said additional sheet comprising the shelf of said chest, and said end portion of said additional sheet comprising the shelf front.

15. The piece of furniture according to claim 9 wherein at least one of said additional sheets is secured at a rod intermediate its end for forming said stressed panel element and wherein the end portion of said sheet beyond said intermediate rod is secured to a rod removably mounted between said panels to form a movable element of said piece of furniture.

16. The piece of furniture according to claim 15 wherein said piece of furniture comprises a chest, said first sheet of tensilely stressed fabric comprising the top, back and bottom panel elements of said chest, said stressed panel element of said additional sheet comprising the shelf of said chest and said end portion of said additional sheet comprising the shelf front.

17. The piece of furniture according to claim 5 wherein said piece of furniture comprises a bookcase, said first tensilely stressed sheet comprising the top, back, and bottom panel elements of said bookcase, said stressed panel element of said additional sheet comprising the shelf of said bookcase.

18. The piece of furniture according to claim 9 wherein said piece of furniture comprises a bookcase, said first tensilely stressed sheet comprising the top, back and bottom panel elements of said bookcase, said stressed panel element of said additional sheet comprising the shelf of said bookcase.

19. The piece of furniture according to claim 1 further including a plurality of rods contiguous with one side of said panel element for supporting said panel element against loading on the other side thereof.

20. The piece of furniture according to claim 1 wherein said tensilely stressed sheet is secured to a rod intermediate its end for forming at least one stressed panel element and wherein the end portion of said sheet beyond said intermediate rod is secured to a rod, removably mounted between said plates to form a movable element of said piece of furniture.

21. The piece of furniture according to claim 20 wherein said piece of furniture comprises a hamper, said tensilely stressed sheet comprising the front, bottom, and back panel elements of said hamper and said end portion comprising the lid of said hamper.

22. The piece of furniture according to claim 8 wherein said additional sheets of fabric form a plurality of storage bins.

23. The piece of furniture according to claim 1 including a rigid load supporting member extending between said side plates for forming an element of said structure.

* * * * *